United States Patent [19]

Lee

[11] 4,288,767

[45] Sep. 8, 1981

[54] AUTOMATIC MAGNETIC SWITCH

[76] Inventor: Wen-Fong Lee, 13-2, Lane 79, Sec. 1, Chung-Kung Rd., Taichung, Taiwan, 400

[21] Appl. No.: 967,712

[22] Filed: Dec. 8, 1978

Related U.S. Application Data

[63] Continuation-in-part of Ser. No. 751,209, Dec. 16, 1976, Pat. No. 4,150,350.

[51] Int. Cl.[3] ..... H01H 73/02; H01H 73/30

[52] U.S. Cl. ..... 335/6; 335/27; 335/207

[58] Field of Search ..... 335/6, 27, 38, 39, 179, 335/205, 206, 207

[56] References Cited

U.S. PATENT DOCUMENTS 3,852,692 12/1974 Moorman ..... 335/205

3,930,213 12/1975 Richards ..... 335/207

*Primary Examiner*—Harold Broome

*Attorney, Agent, or Firm*—Lackenbach, Lilling & Siegel

[57] ABSTRACT

An automatic magnetic switch comprising an over-load or short-circuit protection means and a manual magnetic switch installed in the switch casing. A magnetic control means is contained in a sub-casing of the switch. The manual magnetic switch has a conductive plate with an electrical contact fixedly mounted in its casing and another conductive plate, generally rigid and inflexible, has an electrical contact mounted thereon for pivoting or sliding movement. Permanent magnets, one on the movable plate, and one outside the casing urge the movable plate to a contact engaging position when the outside magnetic member is brought proximate to the casing, and a spring is used to restore the movable plate to its non-engaging position when the outside magnetic member is moved away from the casing. The magnetic control means of said embodiment has a T-lever actuatable by protection means, and a control lever having a second magnet mounted thereon corresponding to a first magnet on the T-lever, a pair of first and second control parts being mounted on a coupling arm of the control lever to lock in first and second stop recesses of a control rod to thereby control the movement of the outside magnet away from or towards the switch casing.

20 Claims, 18 Drawing Figures

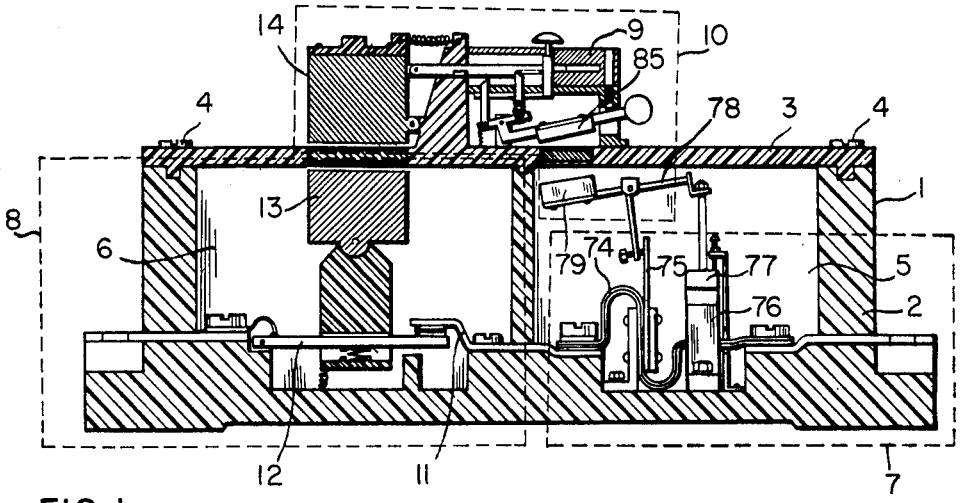
FIG. 1
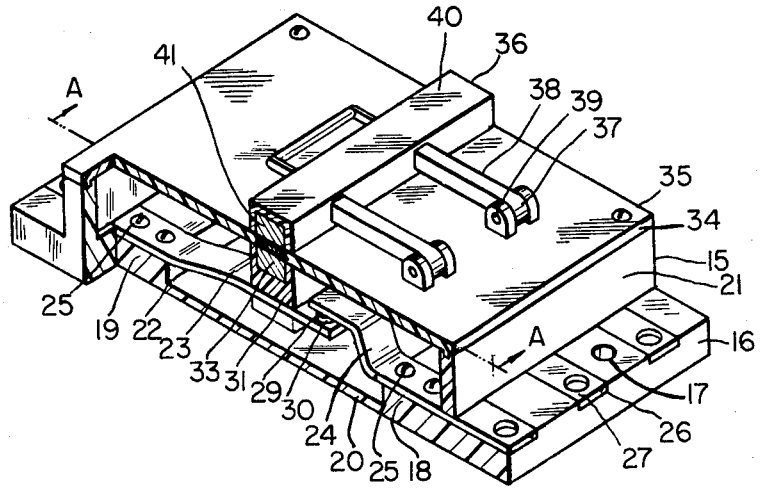
FIG. 2
FIG. 3
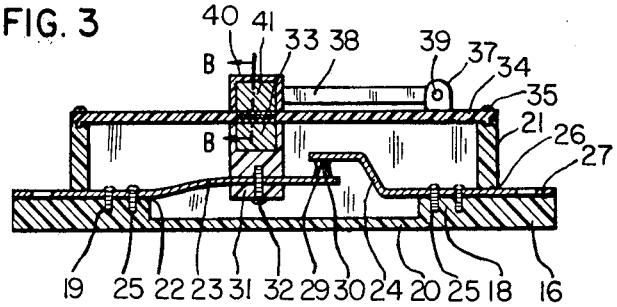

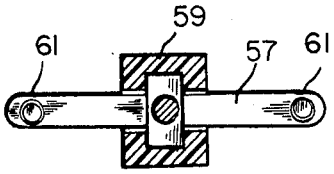
FIG. 9
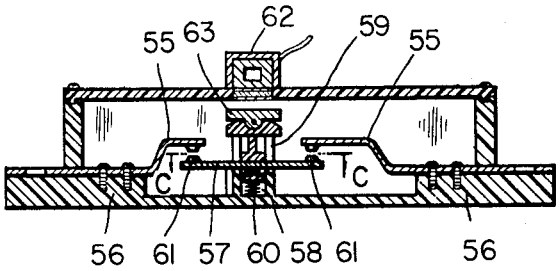
FIG. 8
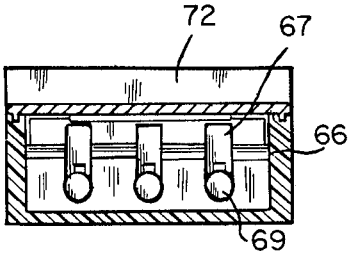
FIG. 11
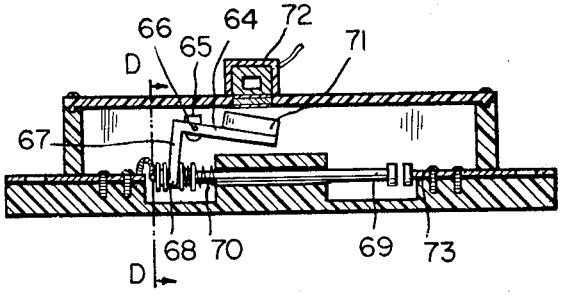
FIG. 10
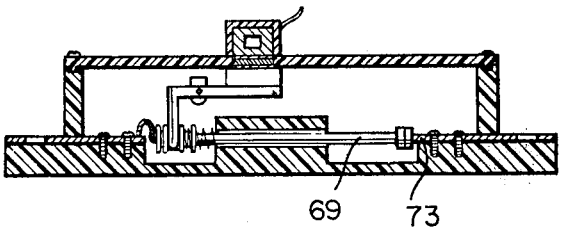
FIG. 12
FIG. 13
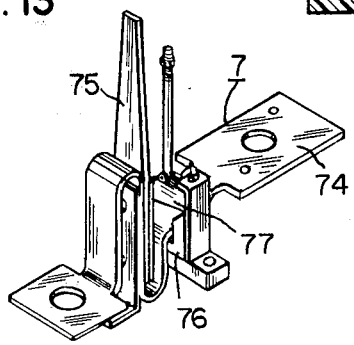

AUTOMATIC MAGNETIC SWITCH

CROSS REFERENCE TO RELATED APPLICATION

This application is a continuation-in-part application of application Ser. No. 751,209, filed on Dec. 16, 1976 which issued as U.S. Pat. No. 4,150,350.

BACKGROUND OF THE INVENTION

The present invention relates to switches, and more specifically to magnetic switches for use in common or specialised applications.

In conventional electric switches, especially those used in power circuits, the contacts are exposed to air, whether the contacts are of the knife or magnetic type. These kinds of switches are not fit for use in a dusty, moist, easily explosive or combustible environment. Several different types of switches for preventing explosions have been developed, such as oil switches, safety switches, and so forth. However, due to the complex constructions of these switches, they are not practical from a manufacturing or economic point of view.

SUMMARY OF THE INVENTION

An object of the present invention is to overcome the above limitations by providing a very simple magnetic switch. By adjusting the distance between a permanent magnet or an electromagnet and a plurality of moving contacts to attract or release the same for contacting corresponding fixed contacts, the goal of closing an electric circuit is achieved.

Another object of the present invention is to provide a switch which includes a chamber filled with insulating oil or a vacuum is maintained therein so as to minimize the arc which is produced during changes in states of the switch from ON-OFF or OFF-ON.

The present invention also preferably provides an electro-magnetic control means for automatically switch off the power circuit when it is over loaded.

Another object of the present invention is to provide the switch with a safety control whereby once the power circuit is off, one has to manually reset the safety control to restore the circuit to an ON state.

Still another object of the present invention is to provide a switch which can be of a construction to reduce the maintenance cost, increase reliability and increase the life time of the switch.

A still further object of the present invention is to provide a magnetic switch which can be of a construction particularly adapted for use in power circuits.

BRIEF DESCRIPTION OF THE DRAWINGS

In the accompanying drawings, which show by way of example preferred embodiments of the invention:

FIG. 1 is a vertical sectional view of an automatic magnetic switch constructed in accordance with the present invention;

FIG. 2 is a perspective view of a manual switch using a permanent magnet and constructed in accordance with the present invention, with part of the casing shown cut away;

FIG. 3 is a vertical sectional view taken along line A-A′ in FIG. 2 showing a closed state of the contacts;

FIG. 8 is a vertical sectional view of another embodiment of a switch showing a spring-loaded contact plate with parallel contacts;

FIG. 9 is a sectional view taken along line C-C′ in FIG. 8 showing the construction of the contact plate;

FIG. 10 is a vertical sectional view of another embodiment of a switch using a horizontally sliding contact;

FIG. 11 is a sectional view on the line D-D′ in FIG. 10;

FIG. 12 is a sectional view of the switch in FIG. 10 showing a closed state of the horizontally sliding contact;

FIG. 13 is a perspective view of the over-load or short-circuit protection means shown in FIG. 1;

DESCRIPTION OF THE PREFERRED EMBODIMENTS

Figure 4:
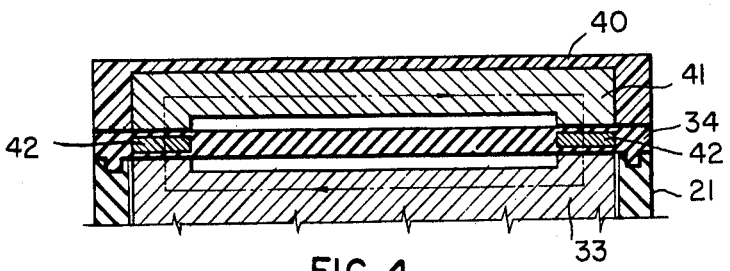
FIG. 4 is a sectional view taken along line B-B′ in FIG. 3 showing magnetic metal blocks disposed in a cover of the switch casing.

Referring to FIG. 1, there is shown a vertical sectional view of an automatic magnetic switch constructed in accordance with the present invention. The automatic magnetic switch 1 includes a switch casing 2 and a cover 3 secured to the switch casing 2 by screws 4. The switch casing 2 includes two adjacent chambers 5 and 6 for containing an over-load or short-circuit protection means 7 and magnetic contacting plate means 8 (actually a manual magnetic switch) respectively. A sub-casing 9 is integrally moulded on the cover 3 forming a housing for the installation of a magnetic control means 10.

The magnetic contacting plate means 8 hereinafter referred to in this description as a manual magnetic switch is one of the important features of this embodiment of the present invention. The manual switch 8 mainly includes a conductive plate 11 with an electrical contact; another conductive plate 12, generally rigid and inflexible, having an electrical contact mounted thereon and being mounted inside the casing 2 for pivoting or sliding movement; and a magnetic member 13, such as a permanent magnet, coupled to the movable conductive plate 12 for urging the latter to a contact engaging position when an outside magnet 13 is brought proximate to the casing 2. Various embodiments or examples are described in detail with reference to FIGS. 2 to 12.

Referring to FIGS. 2 and 3, there are shown perspective and vertical sectional views of a manual magnetic switch constructed in accordance with the present invention, which includes a switch casing 15 made of insulating and non-magnetic materials such as wood, plastics, etc. The casing 15 has two protrusive plates or flanges 16 with a plurality of holes 17 formed thereon for mounting the switch on a surface by screws. Block seats 18 and 19 are moulded on a base 20 of the casing 15 and against the side walls 21. The block seats 18, 19 have a plurality of recesses 22 for receiving electrically conductive plates 23 or Z-shaped electrically conductive plates 24 which plates are fixed on the seats 18 and 19 by screws 25. On the flanges 16, a plurality of conductor seats 26 are provided for permitting the lead conductors 27 to lead away from the casing 15, the conductors being connected to the electrically conductive plates 23 or Z-shaped plates 24 and connected to the same by screws 28. The construction of the electrically conductive plates 23 and Z-shaped plates 24 is suitable for single phase or three phase power applications.

The Z-shaped plates 24 are made of rigid conductive metals with platinum or alloy electrical contacts 29 formed thereon as fixed contacts. When the conductive plates 23 are made of flexible conducting metals, platinum contacts 30 are formed on their ends as moving contacts. Additionally, a block 31 made of insulating and non-magnetic materials is mounted and fixed on the conductive plate 23 by screw 32 as shown with a magnetic 33 being mounted on the block 31. The block 31 is relatively thick in dimension so that the magnetic field induced by the current in the contacting plate 23 does not interfere with the field of the magnet 33 to thereby isolate the same.

The switch casing 15 also contains an accessible wall or a cover 34 attached to the side walls of the casing by screws 35. Actuatable means in the nature of a $\pi$-shaped frame construction 36 is hingedly mounted on the cover 34 by hinges 37, at the ends of supports 38, having hinge pins 39. The $\pi$-shaped frame construction 36 also includes a hollow beam or cross member 40 with a permanent magnet 41 contained in the hollow portion thereof. The permanent magnet 41 is positionable above the magnet 33 and can be positioned to be remote or near the same by rotating the $\pi$-shaped frame construction about the pins 39.

Referring to FIG. 3, when the permanent magnet 41 is near the magnet 33, an attractive force will cause the latter to move upward causing the conductive plate 23 and the contact 30 to move to an engaging position with the fixed contact 29 and thus close the circuit. On the other hand, when the permanent magnet 41 is moved away from the magnet 33, the elastic or restoring force of the conductive plate 23 will overcome the attractive force therebetween causing the plate 23 to move downward to a disengaging position thus breaking the circuit between contact 30 and fixed contact 29. It is not necessary that the above-mentioned $\pi$-shaped frame structure be used. Any method or apparatus which can adjust the attractive force between the permanent magnets 41 and 33 can be used, such as arrangements which use horizontal motion or rotation of the permanent magnet 41 along the surface of the casing cover 34. Furthermore, the chamber in the switch casing 15 is advantageously hermetically sealed and filled with inert gas or insulating oil or a vacuum maintained therein to minimize arcs which are produced during switching or changes in the ON-OFF states.

Referring to FIG. 4, which is a sectional view taken along line B-B' in FIG. 3, there is shown a pair of magnetic blocks 42 which are disposed in the cover 34 of the casing as shown under the beam 40 and the permanent magnet 41 to bridge the space between the latter and magnet 33 and concentrate the magnetic flux and thus enhance the attractive force.

Figure 5:
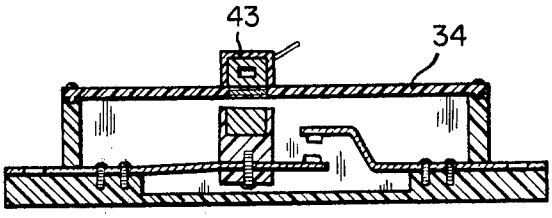
FIG. 5 is a vertical sectional view of an embodiment of a manual switch using an electromagnet and constructed in accordance with the present invention, showing an open state of the contacts.

Referring to FIG. 5, which shows a vertical sectional view of a switch constructed in accordance with the present invention, an electromagnet 43 is fixed on the cover 34 of the casing 15 replacing the permanent magnet 41. The operation of the rest of the parts of the switch is the same as described for the switch in FIGS. 1 and 2.

Figure 6:
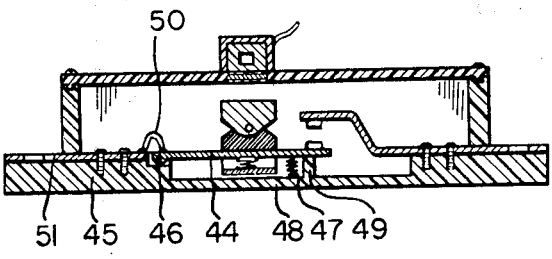
FIG. 6 is a vertical sectional view of an embodiment of a manual switch showing a spring for restoring a contact plate.

Referring to FIG. 6, the conductive plate 44 is generally rigid and inflexible and pivoted on the block seat 45 by a pin 46. Resilient means such as a spring 47 is connected to the conductive plate 44 and to the casing base 48 causing the plate 44 to rest on a seat 49. A flexible wire 50 is connected between the conductive plate 44 resting on seat 49, and the lead-out conductor 51. In this type of switch, the conductive plate 44 can be made of a thicker and harder metal which can conduct larger currents and is thus more suitable for power applications. In addition the ON-OFF operation is much more precise as being spring-operated.

Figure 7:
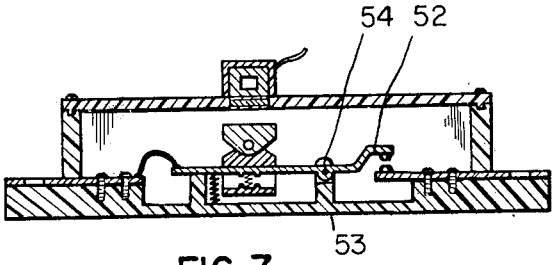
FIG. 7 is a vertical sectional view of an embodiment of a switch wherein a spring-loaded contact plate is pivoted intermediate its ends.

Referring to FIG. 7, the conducting plate 52 is pivoted, intermediate its ends, on a seat 53 by a pivot 54. This switch embodiment has the same operation mechanism as the switch in FIG. 6 except for the pivot position of the contacting plate, said position being in the one case at an end of the plate and being in the other case intermediate the ends of the plate.

Referring to FIGS. 8 and 9, there is shown an example of a spring-operated switch. A pair of contact plates 55 are fixed on the block seats 56 at the input and output sides. A moving conducting plate 57 slidably engages a slot 58 of a vertical bar 59, and downwardly is biased by a spring 60. The moving conducting plate 57 together with the contacts 61 provided thereon move upward to close the circuit upon the establishment of an attraction force between the magnets 62 and 63. FIG. 9 is a sectional view taken along line C-C' in FIG. 8 showing the construction of the moving conducting plate 57 and the slot 58.

Referring to FIGS. 10 and 11 there is shown a vertical sectional view of another embodiment of a switch. A lever 64 pivoted on a support 65 by a pin 66 has a fork arm 67 co-operating with a slip member 68 of a horizontally sliding contact 69. The sliding contact 69 is biased by a spring 70 and can move to the right or to the left according to the attraction force between magnets 71 and 72 through the lever mechanism. The closed state of the horizontally sliding contact 69 with the fixed contact 73 is shown in FIG. 12.

The over-load or short-circuit protection means 7 installed in the chamber 5 of the switch casing 2 is better shown in FIG. 13. This means 7 is a conventional one and includes a current conductive plate 74, a bi-metal 75 and a short-circuit protection electromagnet 76. Referring to FIGS. 1 and 13, the current conductive plate 74 can be fixed to the switch casing 2 by screws. The bi-metal 75 can bend to a certain extent when the power circuit is overloaded with current and the current conductive plate 74 rises in temperature. If any two phases of a three phase power circuit are short circuited, the large current variation in the current conductive plate 74 will cause an induced magnetic flux in the electromagnet 76 thus attracting down the plunger or moving portion 77 of the electromagnet 76.

Figure 14:
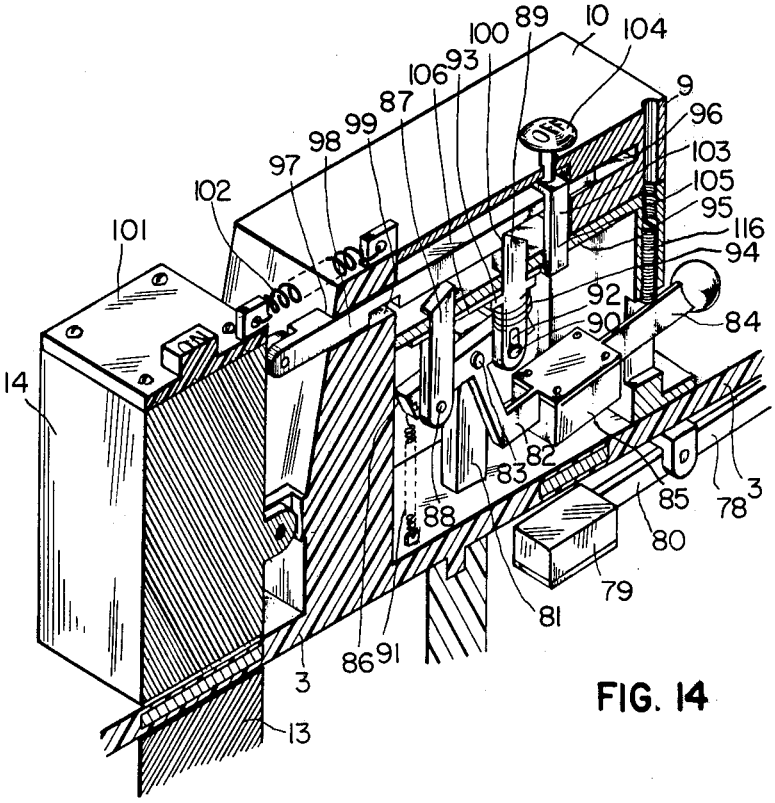
FIG. 14 is a perspective view of electromagnetic control means in an automatic magnetic switch constructed in accordance with the present invention.

Referring to FIG. 14, which is a perspective view of the magnetic control means 10, this magnetic control means 10 is another important feature of the embodiment shown. The magnetic control means 10 has a T lever 78 pivotally mounted to a support extending from a side wall with a first magnet 79 mounted on one end of the transverse lever arm 80 thereof. In the sub-casing 9, a mount 81 extends from the cover 3 and a control lever 82 is pivoted on said mount 81 by a pin 83. The control lever 82 includes a lower transverse arm 84 with a second magnet 85 mounted thereon; a coupling arm 86 with a first control part 87 pivotally mounted thereon by a pin 88 and a second control part 89 slidably mounted with respect to the adjacent end thereof by a bolt 90. A spring 91 connects the coupling arm 86 to the case cover 3. The second control part 89 has a vertical slot 92 engaging with said bolt 90 and a pair of ear portions 93 forming stop means against the action of a spring 94 which normally causes the bolt 90 to rest at the lowest portion of the vertical slot 92. Both the first part 87 and second control part 89 have an inclined surface at the top portions thereof and protrude through a wall 95. The sub-casing 9 also has slots 96 and 97 for containing a control rod 98 which has a first stop recess 99 and a second stop recess 100. The control rod 98 connects to the outside magnet 14 which is fastened to a non-magnetic plate 101 with a spring 102 connecting the same to the sub-casing 9. The magnetic control means 10 also has a manual switch off means 103 which has an arcuate-faced button 104, a forked body portion 105 and a pushing plate 106 installed between the wall 95 and the ear portions 93 of the second control part 89.

Figure 15:
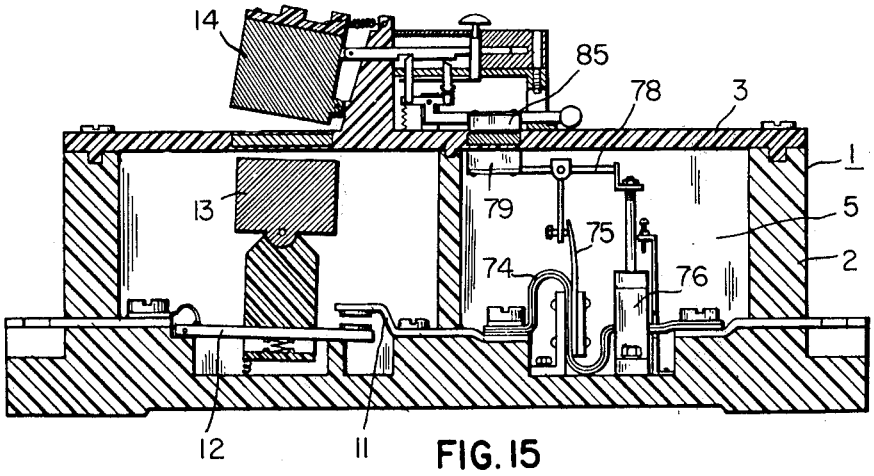
FIG. 15 is a vertical sectional view of the automatic magnetic switch shown in FIG. 1 showing a power circuit at an OFF state.

The operation of the automatic magnetic switch shown will be described hereinafter with reference to FIGS. 1, 14 and 15. When the power circuit is normal, the outside magnet 14 attracts the magnet 13 thus closing the contacts on the current conductive plates 11 and 12 and the second control part 89 locks in the second stop recess 100 of the control rod 98 as shown in FIGS. 1 and 14. Once the power circuit is overloaded or short circuited, the bi-metal 75 or protection electromagnet functions and the T lever 78 starts to rotate causing the first magnet 79 to attract the second magnet 85. Since the second magnet 85 is attracted by the first magnet 79 of the T lever 78, the control lever 82 begins to rotate clockwise, thus the coupling arm 86 forces the second control part 89 to move downwardly and to slip out of the second stop recess 100. The control rod 98 now moves to the right due to the restoring force of the spring 102 and drives the outside magnet 14 away from the cover 3. The control rod 98 will finally be locked by the first control part 87 and the magnet 13 drops down to disengage the contacts of the current conductive plates 11 and 12 as shown in FIG. 15.

It is to be noted that the restoring force of the spring 102 must be larger than the magnetic attractive force between magnets 13 and 14, and the magnetic attractive force between the first magnet 79 and the second magnet 85 must be large than the restoring force of the spring 91. Besides, once the power circuit is automatically switched off, the first and second magnets 79 and 85 remain attracted and the first control part 87 remains locked in the first stop recess 99 of the control rod 98. The outside magnet 14 cannot recover its initial state unless one manually lifts the lower transverse arm 84 of the control lever 82 to cause the first control part 87 to move out of the first stop recess 99 of the control rod 98. Therefore, the lower transverse arm 84 serves as a safety control for the automatic switch. On the other hand, one can push down the manual switch off means 103 via the button 104 to manually switch off the circuit under emergency circumstances.

In the side wall of the sub-casing 9, there is provided a screw 116 for adjusting the position of the lower transverse arm 84. The sensitivity of the automatic magnetic switch can be adjusted by adjusting the screw 116. The lower the transverse arm 84, the higher the sensitivity of the switch.

Figure 16:
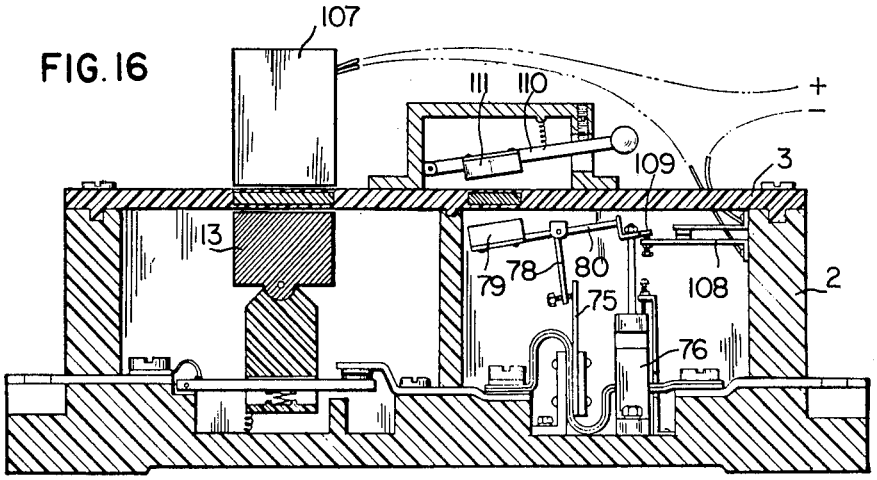
FIG. 16 is a vertical sectional view of another embodiment of an automatic magnetic switch using an electromagnet.

Referring to FIG. 16, which shows an embodiment constructed in accordance with the present invention, an electromagnet 107 is therein employed and a contact means 108 is installed in the switch casing 2. A driving arm 109 is formed to the right end of the transverse lever arm 80 of the T lever 78. A rod 110 with a second magnet 111 is installed in the sub-casing to serve as a safety control for the automatic magnetic switch. When the power circuit is under over-load or short circuit, the T lever 78 will be rotated by the bi-metal element 75 or protection electromagnet 76. The driving arm 109 will break the contacts of the contacts means 108 to cut off the current to the electromagnet 107 the magnet 13 will drop down to switch off the whole power circuit.

Figure 17:
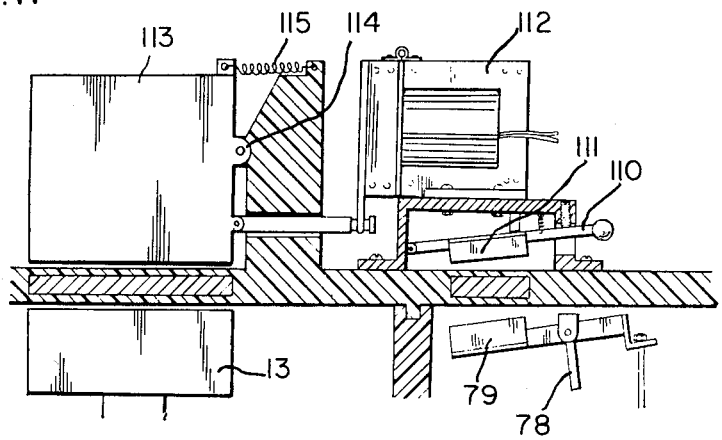
FIG. 17 is a vertical sectional view of another embodiment of an automatic magnetic switch using a solenoid to indirectly control a magnet.

Referring to FIG. 17, which shows another embodiment of an automatic magnetic switch constructed in accordance with the present invention, the construction of the switch in FIG. 17 is similar to that shown in FIG. 16 except the former utilizes a solenoid 112 to indirectly control the outside magnet 113. When the power circuit is under over-load or short circuit, the current of the solenoid 112 will be switched off, the magnet 113 will rotate away from the cover about a shaft 114 due to the restoring force of a spring 115. Again, the rod 110 and the second magnet 111 serve as a safety control for the automatic magnetic switch. This switch embodiment has special advantages and value because a low power solenoid is enough for switching a power circuit. Besides, it can obviate the disadvantages of a conventional magnetic switch, i.e. avoid iron-rust dropping into the switch.

Figure 18:
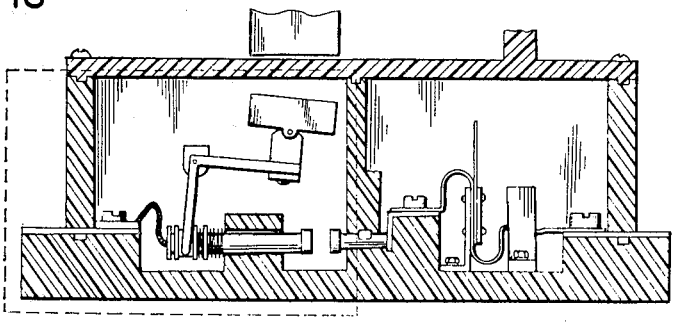
FIG. 18 is a vertical sectional view of still another embodiment of an automatic magnetic switch, using a manual switch shown in FIG. 10.

It is further to be noted that an automatic magnetic switch constructed in accordance with the present invention may have a plurality of variations. For example, the switch in FIG. 18 utilizes the manual switch construction of FIG. 10. As a matter of fact, the switch in FIG. 7 may also be applied to the automatic magnetic switch.

It is also to be noted that the bridging magnets 42 as shown in FIG. 4 may also be applied to the cover between the first magnet 79 and the second magnet 85 or the outside magnet 14 and magnet 13 to concentrate the magnetic flux thus enhancing the attraction force therebetween.

The design of the switch shown provides a novel, safe, simple, economic and practical magnetic switch particularly suitable for high power switching applications.

What I claim is:

1. An automatic magnetic switch comprising a switch casing having a cover, over-load and short-circuit protection means installed in a first chamber of said switch casing, a manual magnetic switch installed in a second chamber of said switch casing, and a magnetic control means at least partially contained in a sub-casing arranged on the cover, said manual magnetic switch having a first electrically conductive plate or means fixedly mounted within said casing; a first electrical contact on said first electrically conductive plate or means; a generally rigid and inflexible second electrically conductive plate or means mounted within said casing for movement between engaging and disengaging positions with respect to said first electrically conductive plate or means; a second electrical contact on said second electrically conductive plate or means arranged to make and break contact with said first electrical contact in the respective engaging and disengaging positions of said second electrically conductive plate or means; resilient means for urging said second electrically conductive plate or means to one of said engaging and disengaging positions; said magnetic control means cooperating with said second electrically conductive plate or means and including actuatable means movable proximate to and away from an accessible wall on the opposite side thereof with respect to said second electrically conductive plate or means, said magnetic control means being actuatable by said over-load and short-circuit protection means to thereby automatically switch off power in the magnetic switch upon the occurrence of an overload or short-circuit condition in said conductive plates and contacts, movement of said actuatable means proximate to said accessible wall moving said second electrically conductive plate or means to the other of said engaging and disengaging positions without material flexure or deformation thereof.

2. An automatic magnetic switch as claimed in claim 1, wherein said switch casing is hermetically sealed.

3. An automatic magnetic switch as claimed in claim 1, wherein said second chamber of the casing is filled with an insulating oil.

4. An automatic magnetic switch as claimed in claim 1, wherein vacuum is maintained within said casing.

5. An automatic magnetic switch as claimed in claim 1, wherein said casing is filled with an inert gas.

6. An automatic magnetic switch as claimed in claim 1, wherein said magnetic control means comprises magnetizable members respectively mounted on said second electrically conductive plate or means and on said actuatable means, at least one of said magnetizable comprising a magnet.

7. An automatic magnetic switch as claimed in claim 6, wherein said magnetizable member mounted on said second electrically conductive plate or means comprises a permanent magnet, and further comprising a non-magnetic block interposed between said second electrically conductive plate or means and said permanent magnet to space and at least partially magnetically isolate the same.

8. An automatic magnetic switch as claimed in claim 1, further comprising magnetizable blocks disposed in said accessible wall and arranged to bridge a substantial portion of the space between said second electrically conductive plate or means and said actuatable means to enhance the magnetic field in the proximate position of said actuatable means.

9. An automatic magnetic switch as claimed in claim 1, wherein said second electrically conductive means is a plate pivotally mounted within said casing.

10. An automatic magnetic switch as claimed in claim 1, wherein said second electrically conductive means is a plate slidably mounted for generally transverse movements.

11. An automatic magnetic switch as claimed in claim 1, wherein said second electrically conductive means comprises a slidably mounted shaft or rod, and a pivotally mounted lever or crank arm cooperating with one end of said shaft or rod to slide the same upon actuation of said lever or crank, whereby said shaft or rod only moves between engaging and disengaging positions along the longitudinal length thereof.

12. An automatic magnetic switch as claimed in claim 1, wherein said magnetic control means comprises a T-lever pivotally mounted to the side wall of the casing with a first magnet mounted on a transverse lever arm thereof; a control lever; a first control part and a second control part pivoted on a coupling arm of said control lever; and a control rod having first and second stop recesses formed thereon to connect an outside magnet.

13. An automatic magnetic switch as claimed in claim 12, wherein said second control part has a pair of ear portions to stop the action of a spring, a vertical slot being formed in the second control part and a bolt passing through said vertical slot; said spring biasing the bolt to rest at the lowest portion of the vertical slot.

14. An automatic magnetic switch as claimed in claim 13, wherein said magnetic control means further comprises a manual switch-off means having an accessible button, a forked body portion and a pushing plate arranged between the wall of said sub-casing and the rear portions of the second control part for manual switch-off of the power circuit upon actuation of said button.

15. An automatic magnetic switch as claimed in claim 1, wherein said magnetic control means includes contact means fixed in the switch casing for switching off the circuit of an outside electromagnet.

16. An automatic magnetic switch as claimed in claim 15, wherein said magnetic control means further includes a driving arm connected to a T-lever for switch-off of the contacts of said contact means when the T-lever is actuated by the over-load and short-circuit protection means.

17. An automatic magnetic switch as claimed in claim 1, wherein said magnetic control means further comprises a solenoid secured on the sub-casing, contact means fixed in the switch casing to switch off the circuit of said solenoid, and an outside magnet connected to a spring to rotate away from the cover of the switch casing when the current in said solenoid is switched off.

18. An automatic magnetic switch as claimed in claim 1, wherein there are provided bridging magnets in the cover at a position between a first magnet and a second magnet to concentrate the magnetic flux to thus enhance the attraction force therebetween.

19. An automatic magnetic switch as claimed in claim 1, wherein there are provided bridging magnets in the cover at a position between an outside magnet and a magnet in the manual magnetic switch to concentrate the magnetic flux to thus enhance the attraction force therebetween.

20. An automatic magnetic switch as claimed in claim 1, wherein said magnetic control means has an adjusting screw for adjusting the position of an arm of a control lever to adjust the sensitivity of the switch.

* * * * *